US005207563A

United States Patent [19]

Ikeda et al.

[11] Patent Number: 5,207,563

[45] Date of Patent: May 4, 1993

[54] SWASH PLATE TYPE COMPRESSOR WITH A CENTRAL DISCHARGE PASSAGE

[75] Inventors: Hayato Ikeda; Toshiro Fujii; Kazuo Murakami; Kazuaki Iwama; Hideo Mori; Shoji Takemoto; Katsunori Kawai; Masaki Nomura; Tetsuya Takashima, all of Kariya, Japan

[73] Assignee: Kabushiki Kaisha Toyoda Jidoshokki Seisakusho, Kariya, Japan

[21] Appl. No.: 884,721

[22] Filed: May 18, 1992

Related U.S. Application Data

[63] Continuation-in-part of Ser. No. 880,574, May 8, 1992, and a continuation-in-part of Ser. No. 863,814, Apr. 6, 1992.

[30] Foreign Application Priority Data

May 20, 1991 [JP] Japan ..... 3-114737
May 20, 1991 [JP] Japan ..... 3-114739

[51] Int. Cl.[5] ..... F04B 27/08

[52] U.S. Cl. ..... 417/269; 91/502; 92/71

[58] Field of Search ..... 184/6.7; 417/269, 271, 417/222 R; 92/71, 110; 91/499, 502; 123/58 BB

[56] References Cited

U.S. PATENT DOCUMENTS 3,079,869 3/1963 Purcell ..... 91/501
3,734,647 5/1973 Sparks ..... 417/269
3,888,604 6/1975 Oshima et al. ..... 417/269
5,052,898 10/1991 Cook ..... 417/269

FOREIGN PATENT DOCUMENTS 35711 4/1979 Japan .
92587 4/1991 Japan .

*Primary Examiner*—Leonard E. Smith
*Attorney, Agent, or Firm*—Brooks Haidt Haffner & Delahunty

[57] ABSTRACT

A swash plate type compressor is provided with a plurality of cylinders and a front and rear cylinder blocks having a crank case connected to a suction port. The cylinder blocks are connected to a front and rear housing sections in order to cover the cylinders. Each housing section contains a discharge chamber. A drive shaft is rotatable supported by the cylinder blocks. One end of the drive shaft is sealed within the front housing. A swash plate is mounted on the drive shaft and is rotatably disposed within the crank case. A plurality of two-head pistons engage the swash plate via a pair of shoes. The pistons move within their respective cylinders in cooperation with the swash plate. The refrigerant is sucked into each cylinder via a suction passage, and is then compressed therein. The refrigerant is discharged into the external refrigerating circuit through the front and rear discharge chambers, .and the front and rear discharge ports. A discharge passage is provided within the drive shaft, and interconnects the front and rear discharge chambers. A valve is provided at one end of the discharge passage to control the opening of the discharge port in relation to the pressure difference between the front and rear discharge chambers.

7 Claims, 6 Drawing Sheets

SWASH PLATE TYPE COMPRESSOR WITH A CENTRAL DISCHARGE PASSAGE

CROSS REFERENCE TO RELATED APPLICATIONS

This is a continuation in part application of the U.S. application Ser. No. 07/880,574, filed on May 8, 1992, entitled SWASH PLATE TYPE COMPRESSOR, and a continuation in part application of the U.S. application Ser. No. 07/863,814, filed on Apr. 6, 1992, entitled SWASH PLATE TYPE COMPRESSOR WITH A CENTRAL DISCHARGE PASSAGE which are incorporated herein by reference.

BACKGROUND OF THE INVENTION

This application claims the priority of Japanese Patent Applications Nos. 3-114737 and 3-114739, both filed on May 20, 1991, and incorporated herein by reference.

FIELD OF THE INVENTION

The present invention relates to swash plate type compressors, and more particularly, it relates to an improved swash plate type compressor for use in vehicles.

DESCRIPTION OF THE RELATED ART

Japanese Unexamined Patent Publication No. 3-92587 discloses a swash plate type compressor which includes a front and rear cylinder blocks. A crank case is connected to a refrigerant suction port, and is located at an interface section between the front and rear cylinder blocks. Each cylinder block has a distal end which is covered by a corresponding housing section. A front valve plate is disposed intermediate the front cylinder block and the front housing section. Similarly, a rear valve plate is disposed intermediate the rear cylinder block and the rear housing section. Each housing sections includes a suction chamber and a discharge chamber. The discharge chamber leads to a refrigerant discharge port.

A drive shaft rotatably enters through an axial opening in the front and rear cylinder blocks. A swash plate is fixedly mounted on the drive shaft and is rotatably disposed within the crank case. The valve plates include suction ports which connect the suction chambers to a plurality of cylinders, via corresponding suction valves. Each valve plate also has a discharge port which connects each discharge chamber with each cylinder via a discharge valve. Each cylinder block has a plurality of suction passages which connect the crank case to the front and rear suction chambers, and a discharge passage which interconnects the front and rear discharge chambers.

The discharge passage is located such that the discharge passage does not interfere with the suction passage and the crank case. Due to design restrictions, such as the limited outer dimensions, the discharge passage has to be positioned close to the suction passage. In this arrangement, however, the refrigerant flows from the refrigerating circuit to the crank case and the suction passage, through the suction ports. The refrigerant absorbs heat from the hot and compressed refrigerant flowing through the discharge passage. The refrigerant is compressed to a higher temperature and is then discharged. As a result, the circulation of the discharged heated refrigerant increases the load on the refrigerating circuit, thus lowering its cooling ability and the overall efficiency of the compressor.

SUMMARY OF THE INVENTION

It is therefore an object of the present invention to avoid the overheating of the refrigerant.

It is also an object of the present invention to reduce the size and weight of the compressor.

In order to achieve the foregoing objects, the swash plate type compressor of the present invention is provided with a plurality of cylinders, and a front and rear cylinder blocks having a crank case connected to a suction port. The cylinder blocks are connected to a front and rear housing sections in order to cover the cylinders. Each housing section contains a discharge chamber.

A drive shaft is rotatably supported by the cylinder blocks.

One end of the drive shaft is sealed within the front housing. A swash plate is mounted on the drive shaft and is rotatably disposed within the crank case.

A plurality of two-head pistons engage the swash plate via a pair of shoes. The pistons move within their respective cylinders in cooperation with the swash plate. The refrigerant is sucked into each cylinder via a suction passage , and is then compressed in each cylinder. Thereafter, it is discharged into the external refrigerating circuit through the front and rear discharge chambers, and the front and rear discharge ports.

A discharge passage is provided within the drive shaft, and interconnects the front and rear discharge chambers. A valve is provided at the end of the discharge passage to control the opening of the discharge port in relation to the pressure difference between the front and rear discharge chambers.

In another embodiment of the present invention, a primary discharge passage is provided within the drive shaft in order to connect the front and rear discharge chambers. A secondary discharge passage is provided to connect the front discharge chamber to the discharge port.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE PREFERRED EMBODIMENT

Figure 1:
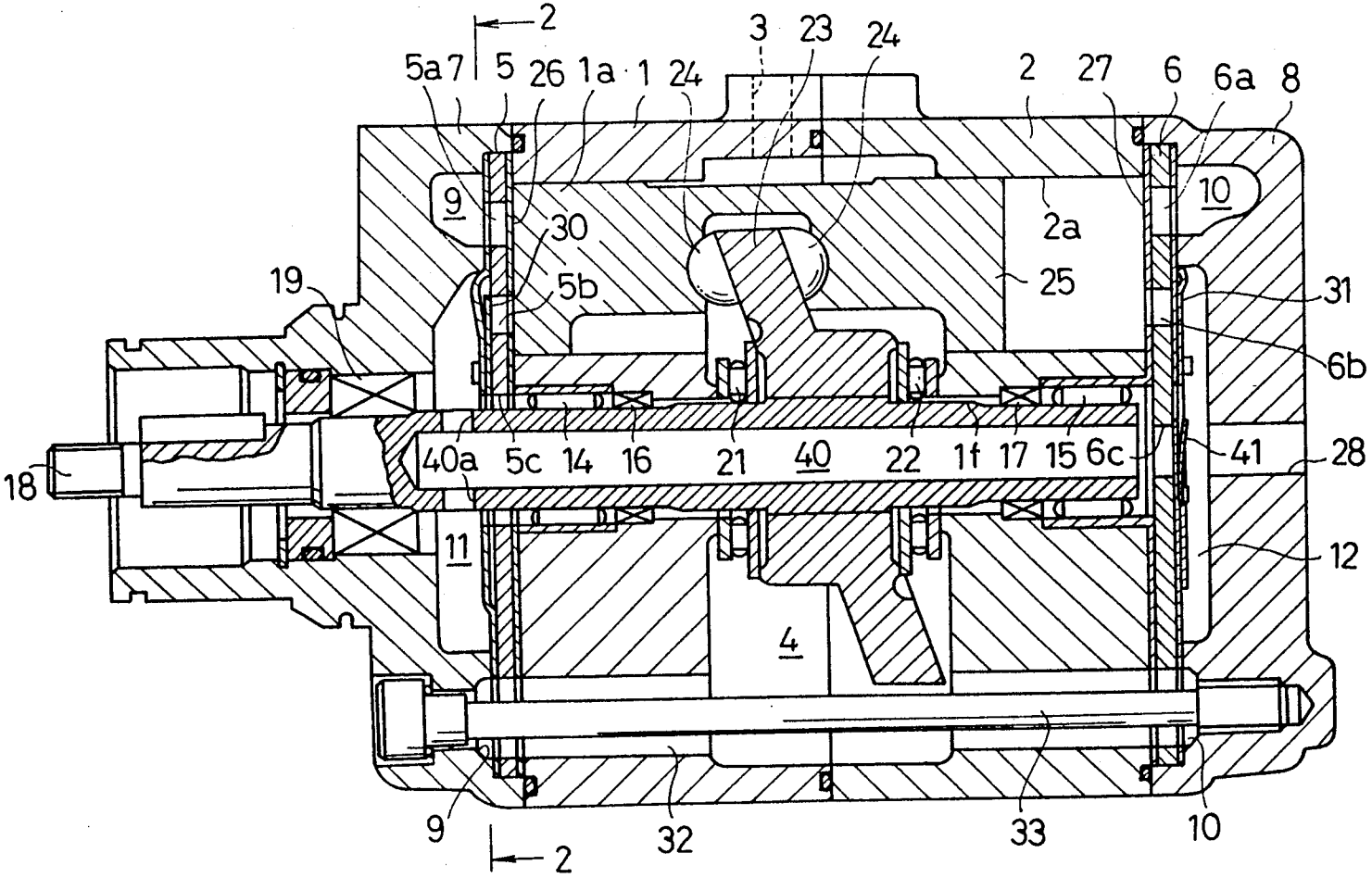
FIG. 1 is a sectional view of a swash plate type compressor according to the first embodiment of the present invention.

FIG. 1 illustrates the preferred embodiment of a swash plate type compressor according to the present invention. The compressor includes a front and rear cylinder blocks 1 and 2 which are oppositely disposed with respect to each other. A crank case 4 is centrally disposed with respect to the cylinder blocks 1 and 2, and leads to a suction port 3. The distal end of the front cylinder block 1 and the distal end of the rear cylinder block 2 are covered by a front and rear housing sections 7 and 8. A front valve plate 5 and a rear valve plate 6 are disposed intermediate their respective cylinder blocks and housing sections.

Figure 2:
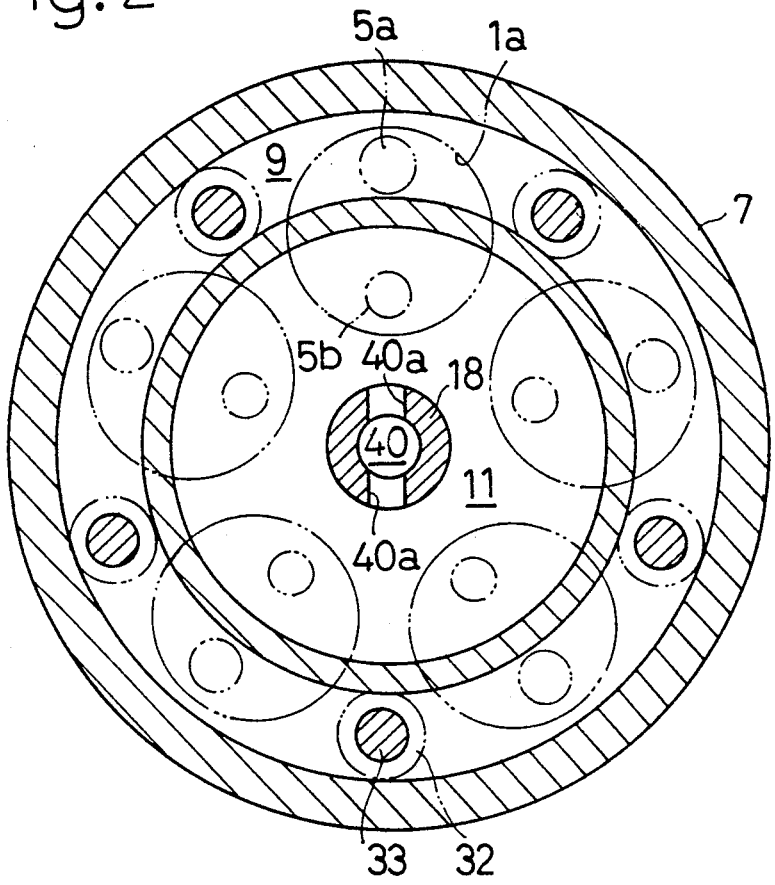
FIG. 2 is a cross sectional view of the compressor of FIG. 1, taken along lien 2—2.

While FIG. 2 illustrates a cross sectional view of the front housing section 7, it should be understood that the rear housing section 8 is substantially similarly designed to the front housing section 7. The front housing section 7 includes an outer ring shaped front suction chamber 9, which is generally concentrically located around an inner ring shaped front discharge chamber 11. The front discharge chamber 11 is in turn concentrically located around a portion of a drive shaft 18.

The drive shaft 18 rotatably engages an axial opening 1*f* which extends through the front and rear cylinder blocks 1 and 2, and which is supported by radial bearings 14 and 15 and sealing devices 16 and 17. The drive shaft 18 further penetrates through an opening 5*c* provided in the front valve plate 5, and extends outwardly through the front housing section 7 via a sealing device 19.

A swash plate 23 is mounted on the drive shaft 18, and rotates within the crank case 4. The swash plate 23 is supported by the front and rear cylinder blocks 1 and 2 via thrust bearings 21 and 22 respectively.

The front and rear cylinder blocks 1 and 2 include a plurality of cylinders such as the cylinders 1*a* and 2*a* which are arranged in parallel with the drive shaft 18 at specified intervals therearound. Each cylinder 1*a* or 2*a* houses a two-head type piston 25. Each piston 25 engages the swash plate 23 via a pair of shoes 24.

The front and rear valve plates 5 and 6 contain suction ports 5*a* and 6*a* respectively. These suction ports 5*a* and 6*a* connect the front and rear suction chambers 9 and 10 with the cylinders 1*a* and 2*a*, via suction valves 30 and 31. The front and rear valve plates 5 and 6 also contain discharge ports 5*b* and 6*b* respectively. These discharge ports 5*b* and 6*b* connect the front and rear discharge chambers 11 and 12 with the cylinders 1*a* and 2*a* via discharge valves 30 and 31.

A plurality of suction passages 32 are provided along the outside circumference of the front and rear cylinder blocks 1 and 2, and connect the crank case 4 with the front and rear suction chambers 9 and 10. A bolt 33 penetrates through the suction passage 32, and secures the front and rear housings 7 and 9 together. A discharge port 28 is opened to the rear discharge chamber 12. The rear discharge chamber 12 is also opened to the axial opening 1*f* provided in the rear cylinder block 2, via an opening 6*c* through the rear valve plate 6.

One important feature of the swash plate type compressor of the present invention is that the drive shaft 18 includes the discharge passage 40 along its axial length. The rear end of the discharge passage 40 is opened to the axial opening 1*f* at the rear end of the drive shaft 18. The front end of the discharge passage 40 is open to the front discharge chamber 11 via an opening 40*a* which includes radial holes or openings that lead to the drive shaft 18. The axial opening 1*f* and the opening or hole 6*c* substantially form a part of the discharge passage 40.

The opening 6*c* contains a valve 41 in the rear discharge chamber 12 to control the opening function of the hole 6*c*. The valve 41 in this embodiment is a reed valve attached to the rear valve plate 6. The valve 41 allows the opening of the hole 6*c* to be freely controlled in relation to the pressure difference between the compressed refrigerant flowing in the front discharge chamber 11 and the rear discharge chamber 12.

In the above arrangement, the refrigerant in the external refrigerating circuit flows into the swash plate type compressor via the suction port 3. The refrigerant is guided into the crank case 4 and is further guided into the front and rear suction chambers 9 and 10, via their respective suction passages 32. The pistons 25 move inside the cylinders 1*a* and 2*a*, and are driven by the swash plate 23 and the drive shaft 18.

The pistons 25 draw the refrigerant into the cylinders 1*a* and 2*a* via the suction ports 5*a* and 6*a*. The refrigerant is then discharged from the cylinders 1*a* and 2*a* into the front and rear discharge chambers 11 and 12, via the discharge ports 5*b* and 6*b*.

The compressed refrigerant which was discharged into the front discharge chamber 11 is guided into the discharge passage 40, via the opening 40*a*. The refrigerant mixes with the compressed refrigerant discharged from the rear discharge chamber 12. The refrigerant is then discharged into the external refrigerating circuit via the discharge port 28.

As described above, the discharge passage 40 is provided inside the drive shaft 18. Therefore, the refrigerant flowing through the crank case 4 and the suction passage 32 is insulated from the hot discharged refrigerant in the discharge passage 40, which is substantially separated from the crank case 4 and the suction passage 32. In this arrangement, unnecessary heat transfer is avoided.

Figure 3:
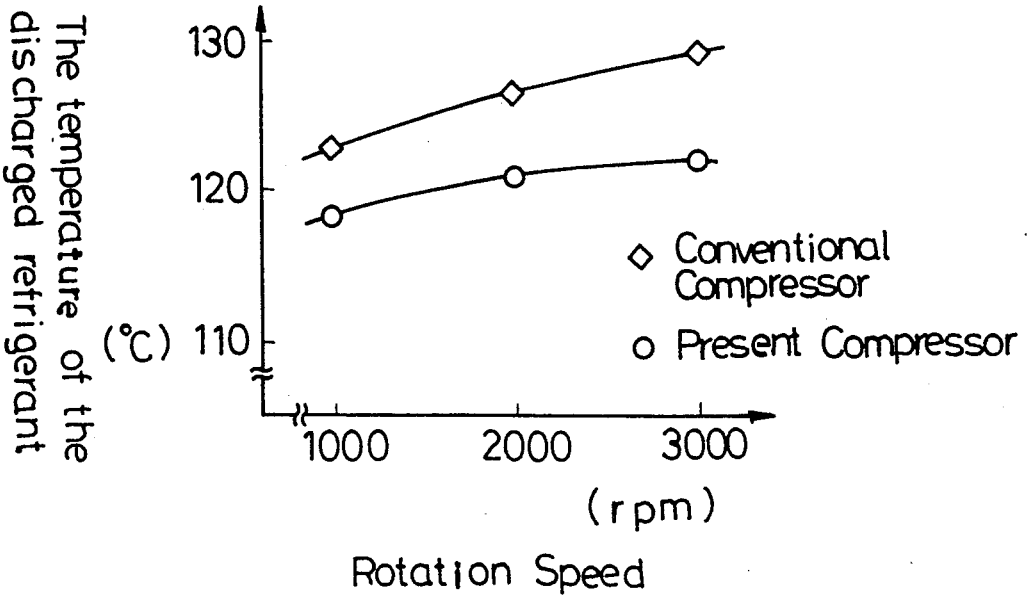
FIG. 3 is a graph showing the relationship between the number of revolutions and the temperature of the discharged refrigerant int he compressor of FIG. 1.

The efficiency of the swash plate type compressor of the present invention will now be compared to a conventional swash plate type compressor, based on the number of revolutions and the temperature of the discharged refrigerant. As shown in FIG. 3, the swash plate type compressor of the present invention shows a temperature reduction of about 5° C. in the range of 1000 to 3000 rpm. This proves a significant improvement in avoiding heat transfer from the discharge passage 40.

In the swash plate type compressor of the present invention, the inner axial opening in the drive shaft 18 is used as a discharge passage 40. This reduces the weight and size of the compressor main body, and further improves the degree of freedom in designing the main components, including the front and rear cylinder blocks 1 and 2.

The opening of the hole 6*c* is controlled by the valve 41 according to the pressure difference between the compressed refrigerant within the front discharge chamber 11 and that within the rear discharge chamber 12. In this arrangement, the pulsation factors of the compressed refrigerant within the front and rear discharge chambers 11 and 12 are evened out by mutual interference without peak synchronization. As a result, the amplitude of each pulsation factor is significantly small.

Experiments indicate that pulsation factors at a high frequency of about 300 Hz could be suppressed most effectively. The frequency referred to herein means the natural frequency of a general type condenser to be connected to the compressor. If the frequency of the condenser were tuned to that of the compressor, resonance may be caused between the condenser and the compressor. The swash plate type compressor of the present embodiment, however, has substantially no resonance and can suppress noise.

Figure 4:
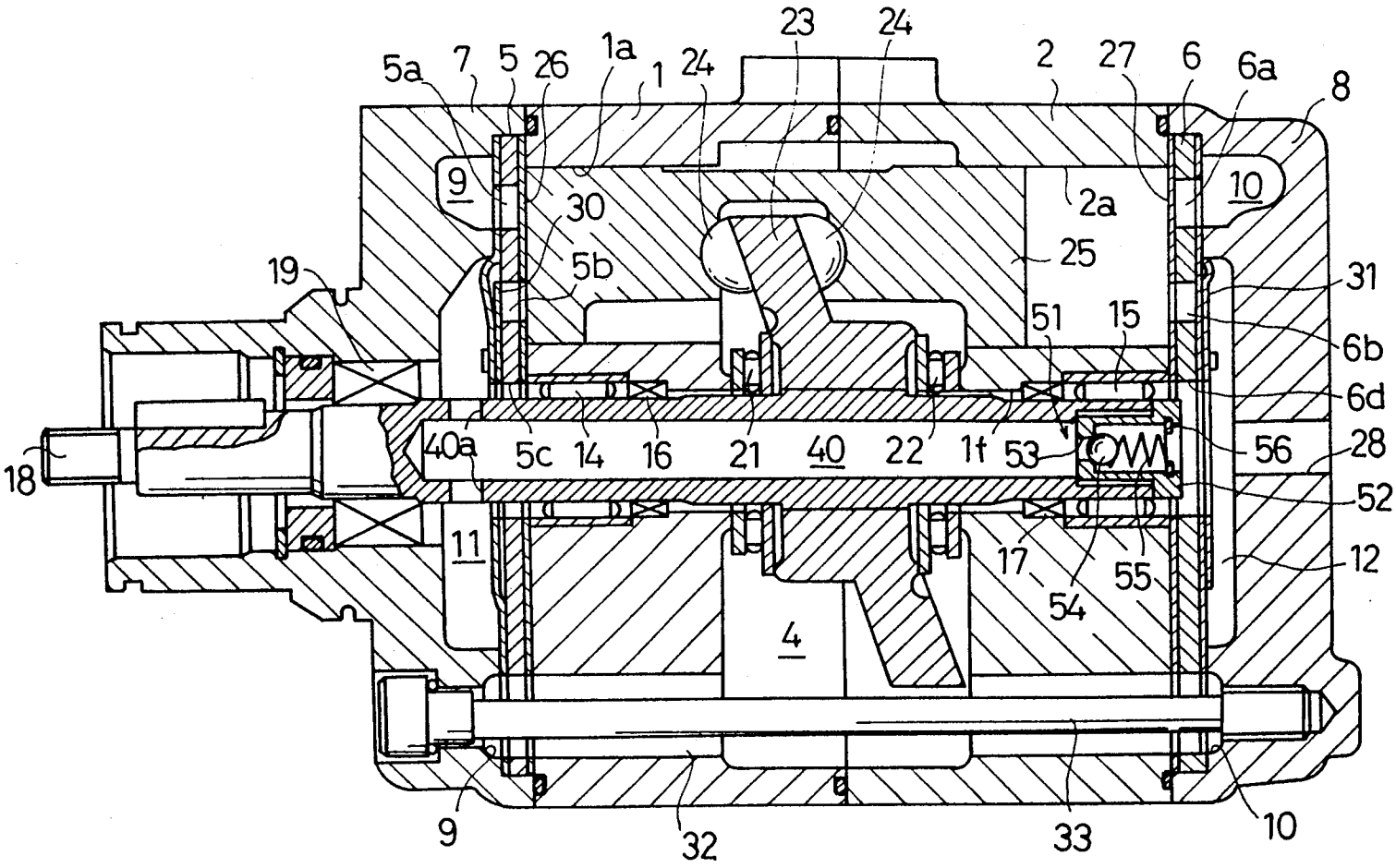
FIG. 4 is a cross sectional view of another embodiment of a swash plate type compressor according to the present invention.

FIG. 4 illustrates another embodiment of the compressor and includes a modified valve in the drive shaft 18. In comparison with the design of the compressor in FIG. 1, there is no significant difference between the two designs, with the exception the alternative embodiment includes a new valve design and an opening 6*d* which is formed slightly larger than that of the preferred embodiment.

In FIG. 4, the valve 51 includes a sleeve 52 connected to the rear end of the drive shaft 18, a ball valve 54 built in the sleeve 52 to control the opening of a hole 53, and a spring 55 which forces the ball valve 54 against a valve seat. The spring 55 is supported at one end by a stop ring 56. The ball valve 54 controls the opening of the hole 53 proportionally to the pressure difference between the compressed refrigerant in the front discharge chamber 11 and that in the rear discharge chamber 12. The valve 54 further suppresses the pulsation factors of the compressed refrigerant, in the same way as the compressor of the first embodiment. The valve can be replaced by another functionally equivalent type valve, such as a float valve.

Figure 5:
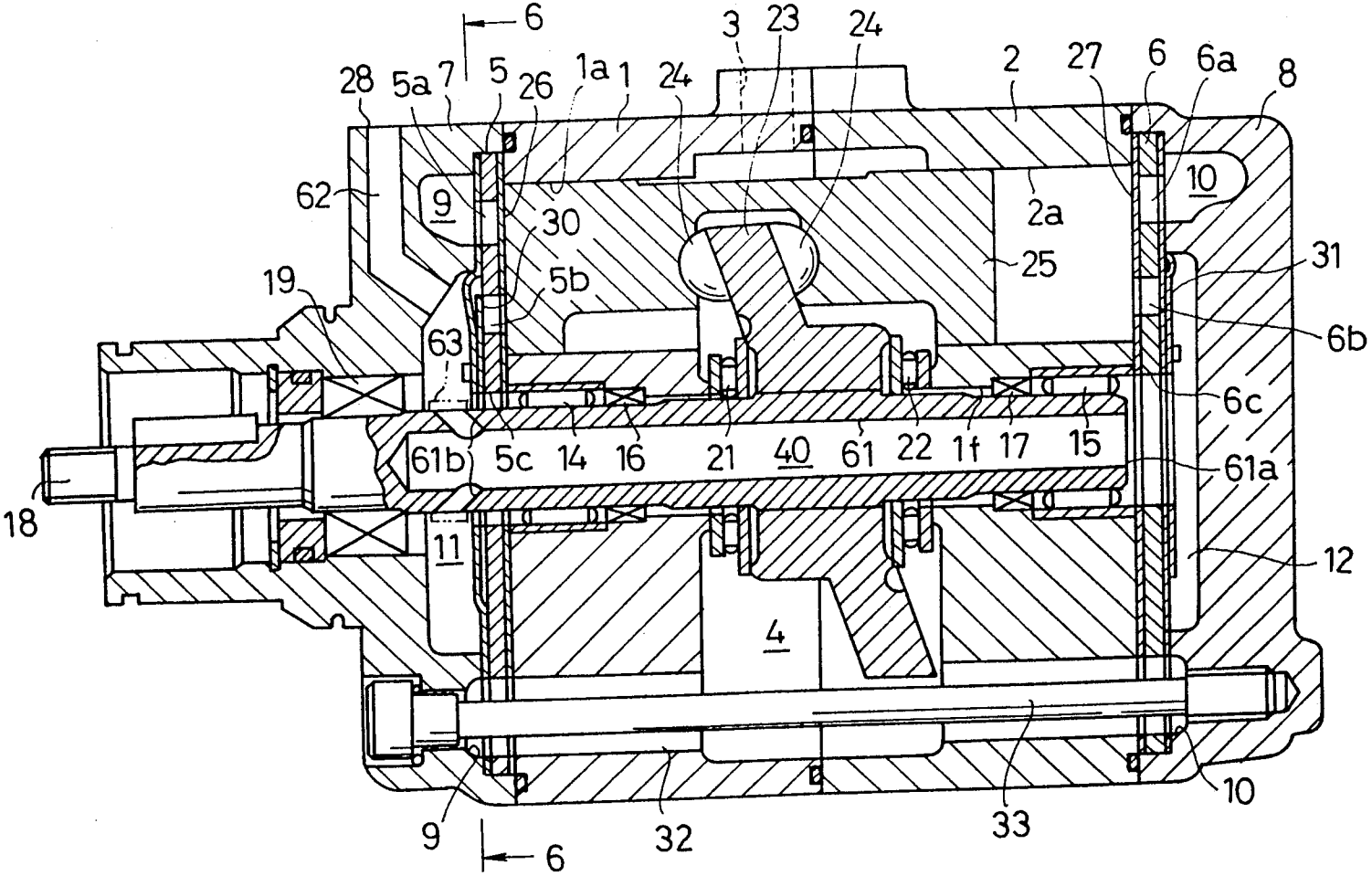
FIG. 5 is a cross sectional view of yet another embodiment of a swash plate type compressor according to the present invention.
Figure 6:
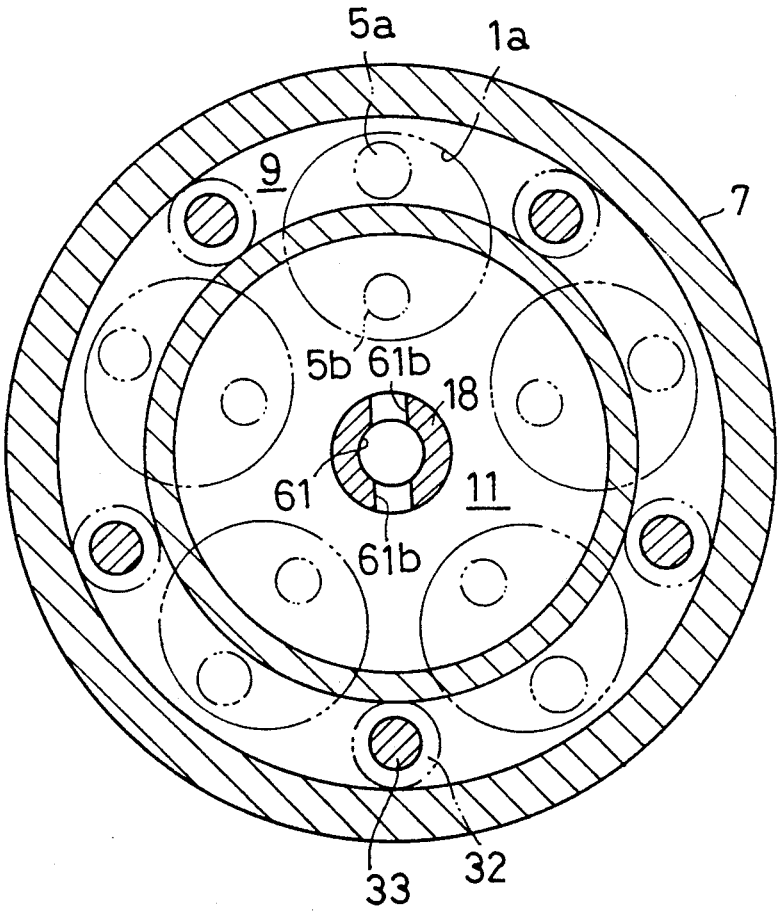
FIG. 6 is a cross sectional view of the compressor of FIG. 5, taken along line 6—6.

Another embodiment of the present invention will now be described with reference to FIGS. 5 and 6. This embodiment differs from the first embodiment with respect to the discharge passage. A primary passage 61 similar to the discharge passage of the first embodiment is provided along the shaft axis of the drive shaft 18. The rear opening 61*a* in the primary passage 61 is opened to the rear discharge chamber 12. A plurality of through holes or openings 61*b* are radially provided in the front part of the drive shaft 18. Each through hole 61*b* is outwardly slanted or directed toward the sealing device 19. Each through hole 61*b* also connects the front discharge chamber 11 with the primary passage 61. The discharge port 28 is provided in the front housing section 7, such that it is open to the external refrigerating circuit and to the front discharge chamber 11 via a secondary passage 62.

In this arrangement, the refrigerant in the external refrigerating circuit is guided into the crank case 4 via the suction port 3. The refrigerant in the crank case 4 is guided into the front and rear suction chambers 9 and 10, via the suction passages 32. The refrigerant is compressed inside the cylinders 1*a* and 2*a*, and is then discharged into the front and rear discharge chambers 11 and 12. The refrigerant within the rear discharge chamber 12 is guided to the primary passage 61 1 via the opening 61*a*. The refrigerant then mixes with the refrigerant from the front discharge chamber 11 via the hole 61*b*, and is thereafter discharged into the external refrigerating circuit, via the secondary passage 62 and the discharge port 28.

The main part of the discharge passage 40 is formed in the drive shaft 18, such that it is separated from the refrigerant suction passage. Therefore, the input refrigerant is sufficiently insulated from the hot and compressed refrigerant in the discharge passage 40.

The refrigerant flows from the rear discharge chamber 12 to the front discharge chamber 11 through the discharge passage 40. The hole 61*b* is slanted in order to facilitate the flow of the refrigerant. Fluid resistance against the refrigerant in the present design, is smaller than the fluid resistance exerted if the refrigerant there flowing in the opposite direction. Furthermore, the centrifugal force caused by the rotation of the drive shaft 18 acts on the fluid refrigerant through the hole 61*b* and accelerates the refrigerant flow. As a result, the refrigerant flows quite smoothly.

Experimentation was conducted to determine the relationship between the number of revolutions of the swash plate type compressor and the temperature of the discharged refrigerant. The results were similar to those of the experimentation of the preferred embodiment. The discharge resistance of the refrigerant within the discharge passage 40 in the fluid direction was also examined with fixed number of revolutions, such as 1000 rpm. Compared with a refrigerant flowing in the reverse direction, the present embodiment consumes less energy, and therefore offers an improved efficiency of the refrigerant fluid resistance.

The opening 61*b* which leads to the front discharge chamber 11 can be substantially enclosed with a beltlike reed valve 63, and used as a valve, similarly to the valve in the preferred embodiment.

Figure 7:
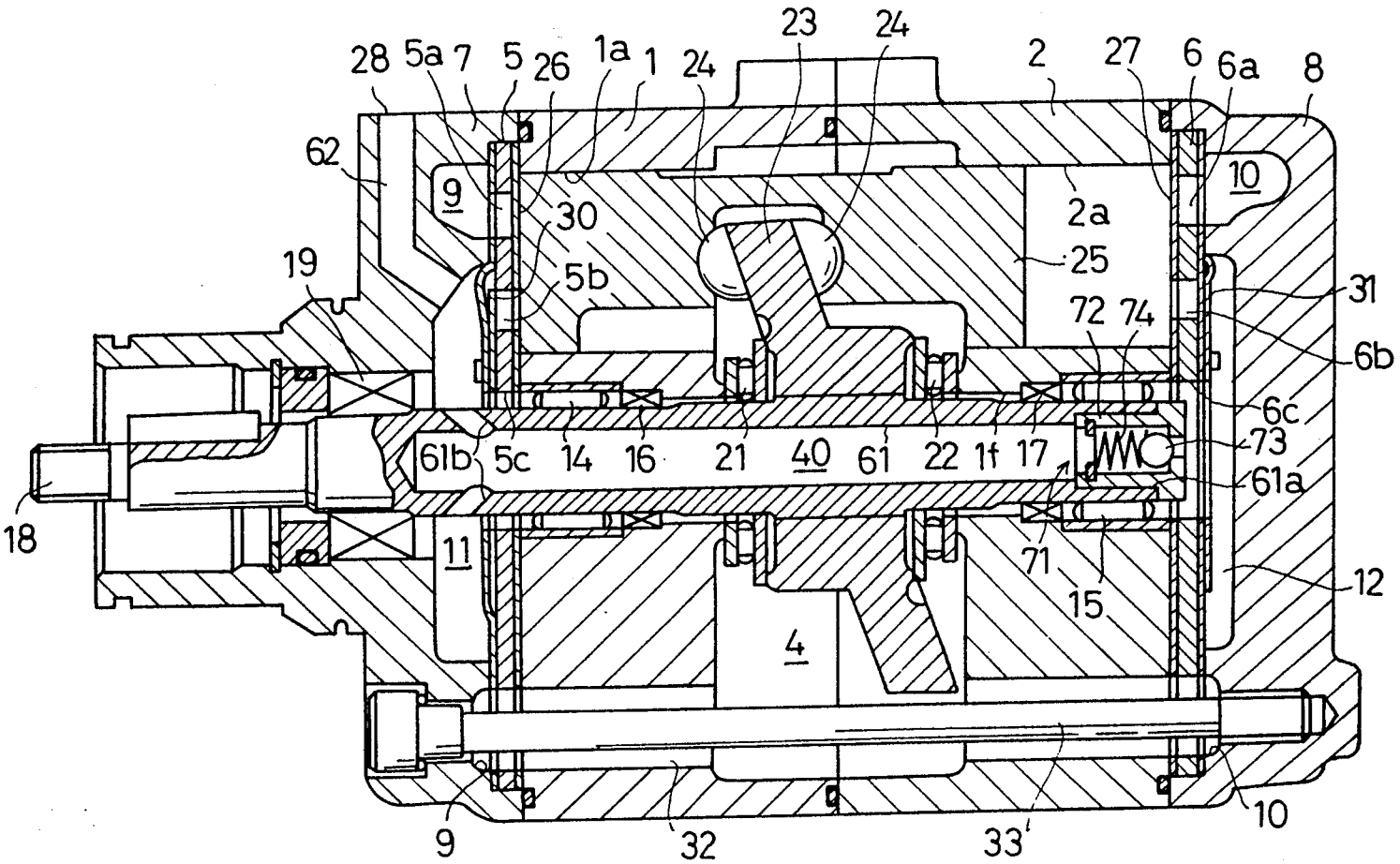
FIG. 7 is a cross sectional view of another embodiment of a swash plate type compressor according to the present invention.

Furthermore, as shown in FIG. 7, a valve 71 can be attached to the through hole 61*a* which is opened to the rear discharge chamber 12. The valve 71 comprises a sleeve 72, a ball valve 73 and a spring 74 etc. like the valve 51. The ball valve 73 is positioned at the side of the through hole 61*a*.

What is claimed is:

1. In a swash plate type compressor of the type having a drive shaft, a plurality of discharge chambers which form a part of a discharge passage, the improvement comprising:

said drive shaft having a hollow section for allowing fluid to pass therethrough, and for forming a part of the discharge passage; and valve means disposed along the discharge passage for controlling the flow of fluid therethrough as a function of the pressure difference of the fluid in the discharge chambers.

2. The compressor of claim 1, wherein the discharge passage includes:

a primary discharge passage which includes said hollow section of the drive shaft, and which interconnects the discharge chambers; and a secondary discharge passage which connects each discharge chamber to a corresponding discharge port.

3. A compressor comprising:

a pair of cylinder blocks having a plurality of cylinder and a crank case leading to a suction port, a pair of housing sections having at least two discharge chambers, and covering both ends of the pair of cylinder blocks, a drive shaft being rotatably supported by the pair of cylinder blocks, a swash plate being mounted on the drive shaft and rotatably housed within the crank case, a plurality of pistons engaging the swash plate and moving within the cylinders in cooperation with the swash plate, wherein the refrigerant flows from the suction port into the cylinder s via a suction passage, and is compressed within each cylinder, and is discharged into the discharge chambers via discharge ports which communicate with the discharge chambers, the compressor comprising:

a primary discharge passage means provided within the drive shaft for causing said discharge chambers to fluidly communicate with each other; and a secondary discharge passage means for causing the front discharge chamber to fluidly communicate with a discharge port provided with the housing sections.

4. The compressor according to claim 3, wherein the compressor includes valve means provided at one end of said discharge passage for communicating with the discharge port, and for controlling the opening of said discharge passage proportionally to the pressure difference between the refrigerant within the discharge chambers.

5. A compressor including a pair of cylinder blocks having a plurality of cylinder and a crank case leading to a suction port, a pair of housing sections having at least two discharge chambers, and covering both ends of the pair of cylinder blocks, a drive shaft being rotatably supported by the pair of cylinder blocks, a swash plate being mounted on the drive shaft and rotatably housed within the crank case, a plurality of pistons engaging the swash plate and moving within the cylinders in cooperation with the swash plate, wherein the refrigerant flows from the suction port into the cylinders via a suction passage, is compressed within each cylinder, and is discharged into the discharge chambers via discharge ports which communicate with the discharge chambers, the compressor comprising:

a discharge passage within the drive shaft and communicating with the discharge chambers; and valve means provided at one end of said discharge passage for communicating with the discharge port, and for controlling the opening of said discharge passage proportionally to the pressure difference between the refrigerant in the discharge chambers.

6. The compressor according to claim 5, wherein the pair of housing sections includes a front and rear housing sections, wherein the pair of cylinder 'locks includes a front and rear cylinder blocks, wherein the discharge port is located within said rear housing section, and wherein the compressor further includes:

a rear valve plate provided between said rear housing section and the rear cylinder block; and a through hole provided in the rear valve plate for controlling the opening of said discharge passage.

7. The compressor according to claim 5, wherein said valve means further includes:

a sleeve in said discharge passage, the sleeve having a through hole;

a ball valve for controlling the opening of said through hole; and spring means for forcing said ball valve against said through hole.

* * * * *

UNITED STATES PATENT AND TRADEMARK OFFICE

CERTIFICATE OF CORRECTION

PATENT NO. : 5,207,563
DATED : May 4, 1993
INVENTOR(S) : H. Ikeda

It is certified that error appears in the above-indentified patent and that said Letters Patent is hereby corrected as shown below:

Column 2, line 54, "lien" should read --line--.

Column 5, line 56, after "61" delete "1".

Column 6, line 64, "cylinder s" should read --cylinders--.

Column 8, line 13, "'locks" should read --blocks--.

Signed and Sealed this

Twenty-ninth Day of March, 1994

Bruce Lehman

*Attest:*

BRUCE LEHMAN

*Attesting Officer*

*Commissioner of Patents and Trademarks*